US007156797B2

(12) United States Patent
Komatsu et al.

(10) Patent No.: US 7,156,797 B2
(45) Date of Patent: Jan. 2, 2007

(54) ASSEMBLING METHOD FOR DEVELOPING ROLLER

(75) Inventors: Noriyuki Komatsu, Numazu (JP); Kazushi Watanabe, Mishima (JP); Ryuta Murakami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 528 days.

(21) Appl. No.: 10/702,614

(22) Filed: Nov. 7, 2003

(65) Prior Publication Data

US 2004/0134070 A1 Jul. 15, 2004

(30) Foreign Application Priority Data

Nov. 8, 2002 (JP) ..... 2002-324851

(51) Int. Cl.
*B25F 5/02* (2006.01)

(52) U.S. Cl. ..... 492/47; 492/45; 492/8

(58) Field of Classification Search ..... 492/8, 492/45, 47; 399/276, 277, 279
See application file for complete search history.

(56) References Cited

U.S. PATENT DOCUMENTS

| | | | | | |
|---|---|---|---|---|---|
| 4,608,737 | A | * | 9/1986 | Parks et al. | 492/8 |
| 4,639,119 | A | * | 1/1987 | Isaka | 399/113 |
| 5,052,336 | A | * | 10/1991 | Fukuchi | 399/104 |
| 5,208,634 | A | | 5/1993 | Ikemoto et al. | 355/215 |
| 5,223,893 | A | | 6/1993 | Ikemoto et al. | 355/200 |
| 5,331,372 | A | | 7/1994 | Tsuda et al. | 355/200 |
| 5,404,198 | A | | 4/1995 | Noda et al. | 355/200 |
| 5,475,470 | A | | 12/1995 | Sasago et al. | 355/210 |
| 5,488,459 | A | | 1/1996 | Tsuda et al. | 355/211 |
| 5,510,878 | A | | 4/1996 | Noda et al. | 355/211 |
| 5,561,504 | A | | 10/1996 | Watanabe et al. | 355/215 |
| 5,583,613 | A | | 12/1996 | Kobayashi et al. | 355/200 |
| 5,623,328 | A | | 4/1997 | Tsuda et al. | 399/111 |
| 5,640,650 | A | * | 6/1997 | Watanabe et al. | 399/117 |
| 5,659,847 | A | | 8/1997 | Tsuda et al. | 399/113 |
| 5,669,042 | A | | 9/1997 | Kobayashi et al. | 399/111 |
| 5,768,658 | A | | 6/1998 | Watanabe et al. | 399/110 |
| 5,790,923 | A | * | 8/1998 | Oguma et al. | 399/106 |
| 5,809,374 | A | | 9/1998 | Tsuda et al. | 399/111 |
| 5,828,928 | A | | 10/1998 | Sasago et al. | 399/111 |
| 5,878,304 | A | | 3/1999 | Watanabe et al. | 399/92 |
| 5,903,803 | A | | 5/1999 | Kawai et al. | 399/116 |
| 5,937,242 | A | | 8/1999 | Yokoyama et al. | 399/114 |
| 5,966,568 | A | | 10/1999 | Numagami et al. | 399/111 |
| 6,006,058 | A | | 12/1999 | Watanabe et al. | 399/167 |

(Continued)

FOREIGN PATENT DOCUMENTS

| | | |
|---|---|---|
| JP | 2000-283151 | 10/2000 |

(Continued)

*Primary Examiner*—Marc Jimenez
(74) *Attorney, Agent, or Firm*—Fitzpatrick, Cella, Harper & Scinto

(57) ABSTRACT

An assembling method that is for a developing roller usable with a developing device. The developing roller includes a developer carrying member in the form of a hollow cylinder, a flange member provided at an end of the developer carrying member, and a magnet provided in the developer carrying member. The method includes an inserting step of inserting the magnet having at least one projection into an inside of the developer carrying member through an opening of the developer carrying member; an abutting step of abutting the at least one projection to an inside surface of the cylinder of the developer carrying member; and an engaging step of engaging the flange member with the opening by penetrating the flange member with a shaft of the magnet projected out of the opening.

5 Claims, 15 Drawing Sheets

(a) (b)

U.S. PATENT DOCUMENTS 6,016,413 A 1/2000 Yokoyama et al. ..... 399/113
6,029,032 A 2/2000 Watanabe et al. ..... 399/111
6,070,028 A 5/2000 Odagawa et al. ..... 399/104
6,075,956 A 6/2000 Watanabe et al. ..... 399/92
6,097,909 A 8/2000 Watanabe et al. ..... 399/111
6,101,354 A 8/2000 Nakagawa et al. ..... 399/225
6,118,960 A 9/2000 Nakagawa et al. ..... 399/111
6,128,454 A 10/2000 Kawai et al. ..... 399/116
6,144,398 A 11/2000 Yokoyama et al. ..... 347/263
6,160,976 A 12/2000 Karakama et al. ..... 399/104
6,163,665 A 12/2000 Watanabe et al. ..... 399/111
6,169,866 B1 1/2001 Watanabe et al. ..... 399/111
6,175,706 B1 1/2001 Watanabe et al. ..... 399/167
6,226,478 B1 5/2001 Watanabe et al. ..... 399/117
6,236,821 B1 5/2001 Yokoyama et al. ..... 399/113
6,246,849 B1 6/2001 Yokoyama et al. ..... 399/117
6,272,299 B1 8/2001 Numagami et al. ..... 399/111
6,324,363 B1 11/2001 Watanabe et al. ..... 399/111
6,330,402 B1 12/2001 Sakurai et al. ..... 399/12
6,330,409 B1 12/2001 Watanabe et al. ..... 399/111
6,336,018 B1 1/2002 Kawai et al. ..... 399/117
6,377,759 B1 4/2002 Abe et al. ..... 399/27
6,397,017 B1 5/2002 Sakai et al. ..... 399/27
6,397,018 B1 5/2002 Matsumoto et al. ..... 399/27
6,400,914 B1 6/2002 Noda et al. ..... 399/90
6,408,143 B1 6/2002 Sakurai et al. ..... 399/27
6,501,926 B1 12/2002 Watanabe et al. ..... 399/117
6,571,070 B1 5/2003 Oguma et al. ..... 399/27
6,594,454 B1 7/2003 Oguma et al. ..... 399/90
6,625,413 B1 9/2003 Oguma et al. ..... 399/222
6,654,567 B1 11/2003 Karakama et al. ..... 399/25
6,658,224 B1 12/2003 Yokoi et al. ..... 399/113
6,934,485 B1 * 8/2005 Miyabe et al. ..... 399/90
2001/0038758 A1 11/2001 Oguma et al. ..... 399/27
2002/0025185 A1 2/2002 Ito et al. ..... 399/111
2002/0025186 A1 2/2002 Karakama et al. ..... 399/111
2002/0031357 A1 3/2002 Watanabe et al. ..... 399/12
2002/0081125 A1 6/2002 Karakama et al. ..... 399/111
2002/0131791 A1 9/2002 Yokoi et al. ..... 399/113
2003/0068172 A1 4/2003 Komatsu et al. ..... 399/113
2003/0108358 A1 6/2003 Yokoi et al. ..... 399/109
2003/0113131 A1 6/2003 Watanabe et al. ..... 399/111
2003/0161657 A1 8/2003 Yokoi et al. ..... 399/119

FOREIGN PATENT DOCUMENTS

JP 2001-134097 5/2001

* cited by examiner

ASSEMBLING METHOD FOR DEVELOPING ROLLER

FIELD OF THE INVENTION AND RELATED ART

The present invention relates to an assembling method for a developing roller usable with a developing device.

A conventional developing roller, a process cartridge using such a developing roller, and an assembling method for the developing roller, will be described.

(Structure of Developing Roller)

FIGS. 10(*a*) and 10(*b*) illustrate an assembling method for a developing roller 20. One end of a fixed magnet 28 is provided with a supporting shaft 28*a* and the other end is provided with supporting shaft 28*b* having a cut-away portion 28*c* for phase alignment of the magnet 28. The developing roller 20 has a blank tube member 18 and a flange 18*a* press-fitted thereinto. The developing roller 20 is rotatably supported on a developing device frame (unshown) of an image forming apparatus by way of a bearing 27. The magnet 28 is disposed in the developing roller 20. The developing roller 20 is provided at the end thereof with a developing roller gear 72. The developing roller 20 is urged toward the photosensitive drum with a predetermined constant clearance (gap) therebetween by spacer rollers 26.

(Process Cartridge)

FIG. 11 illustrates an exemplary process cartridge C using such a developing roller. A photosensitive member unit B of the cartridge C includes charging means 11 for uniformly charging a surface of the photosensitive layer of a photosensitive drum 10 on which an electrostatic latent image is to be formed. It also includes cleaning means 14 for scraping residual toner, which has not been transferred onto a transfer material but remains on the photosensitive drum 10, off the surface of the photosensitive drum 10 and for storing the scraped toner in a residual toner container 12 thereof.

A developing device unit A includes a toner container 21 accommodating the toner and a developing roller 20 for forming a visualized image by supplying toner to the electrostatic latent image formed on the photosensitive drum 10. Furthermore, the developing device unit A contains a developing blade 22 for applying triboelectric charge to the toner and forming a toner layer on a surface of the developing roller 20 and a preventing sheet 25 for toner sealing and for preventing toner leakage in the radial direction of the developing roller 20. The developing device unit A and the photosensitive member unit B are rotatably coupled with each other by an engaging pin 31, and there is provided an urging spring 32 for biasing them.

The photosensitive drum 10 is rotatable in the clockwise direction as indicated by arrow R. The charging means 11 is supplied with a constant voltage, and the surface of a photosensitive layer of the photosensitive drum 10, which is contacted to the charging means 11, is uniformly charged electrically. The photosensitive drum 10 receives a laser beam L through an exposure opening 2, the laser beam L being modulated in accordance with image information to be printed, from optical means 1 of the image forming apparatus. By doing so, an electrostatic latent image is formed on photosensitive drum 10. Then, the latent image is developed into a toner image on the photosensitive drum 10 by the function of the developing roller 20.

The toner in the toner container 21, is discharged to the developing roller 20 by rotation of the toner feeding member 23. The developing roller 20 is rotated, and a layer of the toner which is triboelectrically charged by the developing blade 22, is formed on the surface of the developing roller 20. In this manner, a toner image is formed on the photosensitive drum. The toner image is transferred onto a transfer material P by transferring means 3. Thus, a toner image is formed on the transfer material P.

(Conventional Assembling Method)

A description will be provided as to a conventional developing roller assembling method. FIG. 12 shows a conventional developing roller assembling apparatus. The conventional developing roller assembling apparatus comprises an apparatus base 100, a feeding turret 110 for feeding the developing rollers 20, and a flange feeding unit 130 for feeding the flanges 19. It further comprises a press-fitting unit 140 for press-fitting the flange 19 into the developing roller 20 while chucking the flange 19, and a robot hand 150 for mounting the flange 19 on the press-fitting unit 140 from the flange feeding unit 130.

In operation, the magnet 28 having one end to which the flange 18*a* is press-fitted is inserted into the blank tube 18 (FIG. 10, (*a*)). Then, the blank tube 18 into which the magnet 28 has been inserted is set at position C on the feeding turret 110 (FIG. 12). At this time, an end surface 18*b* of the flange 18*a* is abutted to an abutment surface 111 of the feeding turret 110 so that vertical position of the magnet is determined. Simultaneously, the lower clamp 112 clamps the lower portion of the blank tube 18. The feeding turret 110 is rotated in the clockwise direction (L) in the figure to feed the mounted blank tube 18. When the blank tube 18 reaches a position D, the upper clamp 113 clamps the upper portion of the blank tube 18 to determine the radial position thereof. Subsequently, the blank tube 18 is fed to a flange press-fitting position E.

The flange 19 is fed in another route (left side in the figure) by a conveyer belt 131 provided in the flange feeding unit 130. When the flange 19 is fed to a predetermined position, the conveyer belt 131 is stopped. The fed flange 19 is taken up by a robot hand 150, and is fed to a flange attracting portion 141 of the press-fitting unit 140. The flange attracting portion 141 is provided with a recess (unshown) in nesting alignment with the flange 19. When the flange 19 is fed to the recess, an air pump (unshown) is operated for air attraction of the flange 19.

When the blank tube 18 is fed to the flange press-fitting position E on the feeding turret 110, the press-fitting unit 140 attracting the flange 19 moves downward. Then, the flange 19 is press-fitted into the opening 18*b* of the blank tube 18. When the press-fitting of the flange 19 is completed, the operation of the air pump is stopped, and the unit 140 returns to the home position.

FIG. 13 shows an assembling method of the developing roller 20. The magnet 28 is provided at its one end with a supporting shaft 28*a* and is provided at the other end with a supporting shaft 28*b* having a cut-away portion 28*c* effective to determine a phase position of the magnet 28. The developing roller 20 has a blank tube 18 into which the flange 18*a* is press-fitted. In the assembling operation, the supporting shaft 28*b* is inserted through the opening 18*b* of the blank tube 18. The flange 19 is press-fitted by way of the supporting shaft 28*a* projected outwardly at least partly from the opening 18*b* of the blank tube 18.

FIGS. 14(*a*) and 14(*b*) are sectional views, illustrating the states before and after the flange press-fitting. FIG. 14(*a*) shows a state in which the flange is not yet press-fitted, and FIG. 14(*b*) shows the state in which the flange has been press-fitted. The magnet 28 inserted into the blank tube 18 has a large diameter portion 28*d* which is contacted to the inside circumference 20*a* of the blank tube 18. At this time, the axis 201 of the magnet 28 is eccentric relative to the axis 200 of the blank tube 18. In the case that magnet 28 has a circular cross-section, and that the dimensional difference between the large diameter portion 28*d* of the magnet 28 and the inside circumference 20*a* of the blank tube 18 is small, the amount of the eccentricity is small. Therefore, a constant clearance can be relatively easily provided between the supporting shaft 28*a* and the inside circumference 19*a* of the flange 19. And, the flange 19 can be press-fitted into the opening 18*b* (for example, Japanese Laid-open Patent Application 2000-283151 and Japanese Laid-open Patent Application 2001-134097).

However, as shown in FIGS. (15(*a*) through 15(*c*), when a fixed magnet 29 having a small diameter is used, the dimensional difference between the large diameter portion 29*d* of the magnet 29 and the inside circumference 20*a* of the blank tube 18 is large. As a result, the eccentricity between the axis 200 of the blank tube 18 and the axis 201 of the magnet 29 is large. Then, in the step of press-fitting the flange 19, interference occurs between the supporting shaft 29*a* of the magnet 29 and the inside circumference 19*a* of the flange 19. When the diameter is small as with the magnet 29, the axis 201 of the magnet 29 largely deviates from the axis 202 of the flange 19. For this reason, the operativity in press-fitting the flange 19 into the blank tube 18 into which the magnet 29 has been inserted, is poor.

Accordingly, it is a principal object of the present invention to provide a developing roller assembling method wherein a developer carrying member and a magnet can be easy assembled.

It is another object of the present invention to provide a developing roller assembling method wherein the operability in assembling the magnet and the developing roller is improved. According to an aspect of the present invention, there is provided an assembling method for a developing roller usable with a developing device, the developing roller including a developer carrying member in the form of a hollow cylinder, a flange member provided at an end of the developer carrying member, and a magnet provided in the developer carrying member, the method comprising an inserting step of inserting the magnet having at least one projection into an inside through an opening of the developer carrying member; an abutting step of abutting the at least one projection to an inside surface of the cylinder; and an engaging step of engaging the flange member with the opening by penetrating the flange member with a shaft of the magnet projected out of the opening.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
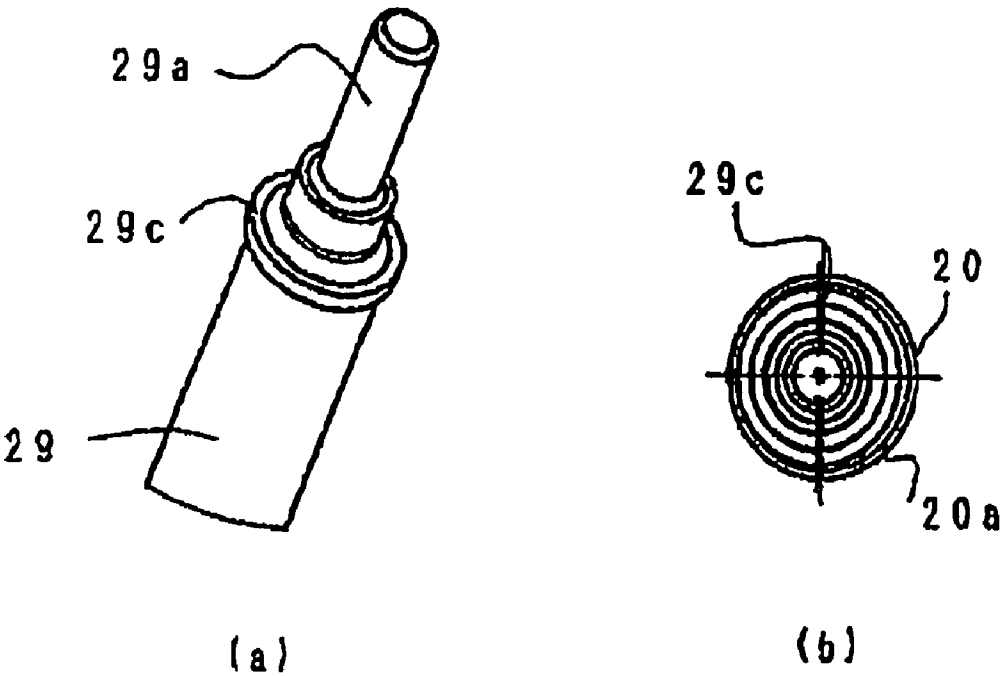
FIGS. 1(*a*) and 1(*b*) illustrate an example of a configuration of an end of a stationary magnet having a small diameter, according to a first embodiment of the present invention.

A description will be provided as to a first embodiment of the present invention. The description will be provided as to a structure of a fixed small diameter magnet which is mounted according to a developing roller assembling method of the present invention. Then, a structure of an assembling apparatus which implements an assembling method for the developing roller of this embodiment will be described. The same reference numerals are assigned in all of the elements to the elements having the corresponding functions, and the detailed description thereof is omitted for simplicity.

First Embodiment

According to a conventional method, the eccentricity of the magnet 29 relative to the blank tube (developer carrying member) is large, as described hereinbefore. According to this embodiment, the magnet (magnet member) 29 is provided at its end portion with a projected configuration (projected portion) 29*c*. This is effective to prevent an eccentricity of the magnet 29. FIGS. 1(*a*), 1(*b*), 2(*a*), 2(*b*), 3(*a*), and 3(*b*) illustrate examples of the projected configuration 29*c* provided at the end of the magnet 29. In the example of FIGS. 1(*a*) and 1(*b*), the projected configuration is extended all around; in the example of FIGS. 2(*a*) and 2(*b*), two projected configurations are provided; and in the example of FIGS. 3(*a*) and 3(*b*), the projected configuration is provided at one point.

In the example of FIGS. 1(*a*) and 1(*b*), the projected configuration portion 29*c* is extended along the full circumference of the magnet 29. Therefore, when the magnet 29 is inserted into the blank tube, the projected configuration 29*c* is abutted to the inside circumference 20*a* of the blank tube 18.

By doing so, the eccentricity between the axis of the magnet 29 and the axis 200 of the blank tube 18 made small. As a result, the clearance between the supporting shaft 29*a* of the magnet 29 and the inside circumference 19*a* of the flange 19 is substantially constant all around. Thus, the flange 19 can be easily press-fitted into the opening 18*b* of the blank tube 18.

Figure 2:
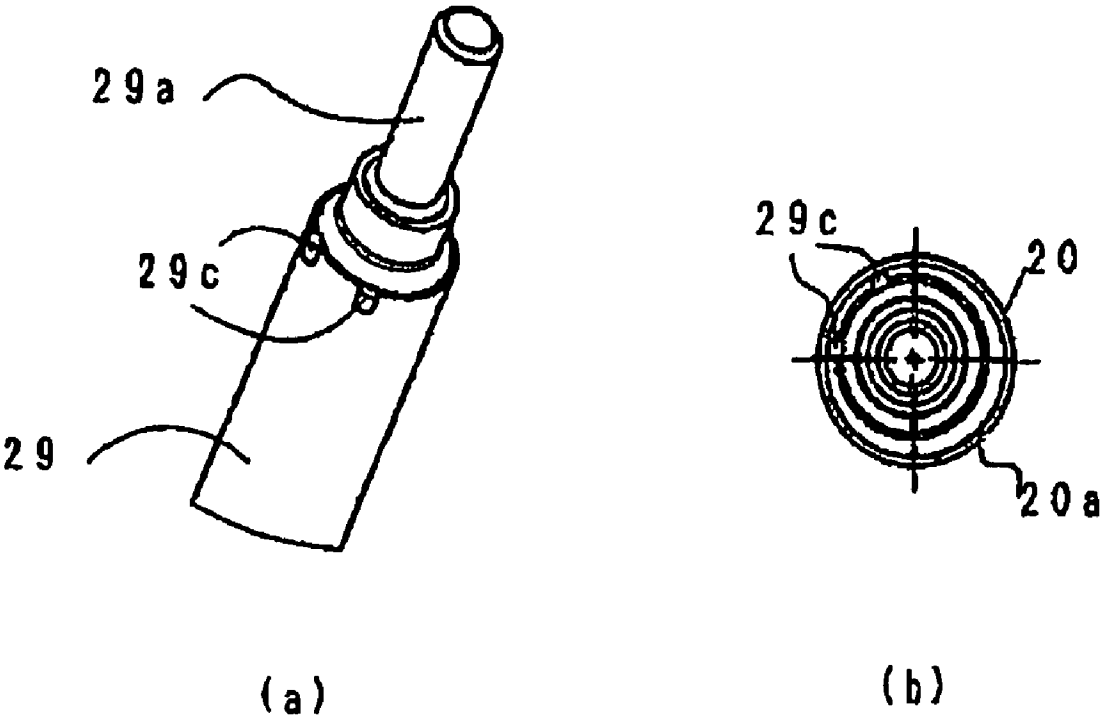
FIGS. 2(*a*) and 2(*b*) illustrate an example of a configuration of an end of a stationary magnet having a small diameter, according to the first embodiment of the present invention.

In the example of FIGS. 2(*a*) and 2(*b*), the magnet 29 is provided at its end with two projected configuration portions. By doing so, when the magnet 29 is inserted into the blank tube 18, the projected configuration portion 29*c* is contacted to or abutted to the inside circumference 20*a* of the blank tube 18. By doing so, the eccentricity between the axis 201 of the magnet 29 and the axis 200 of the blank tube 18 is made small. As a result, the clearance between the supporting shaft 29*a* the inside circumference 19*a* of the flange 19 is substantially constant all around. Thus, the flange 19 can be easily press-fitted into the opening 18*b* of the blank tube 18.

Figure 3:
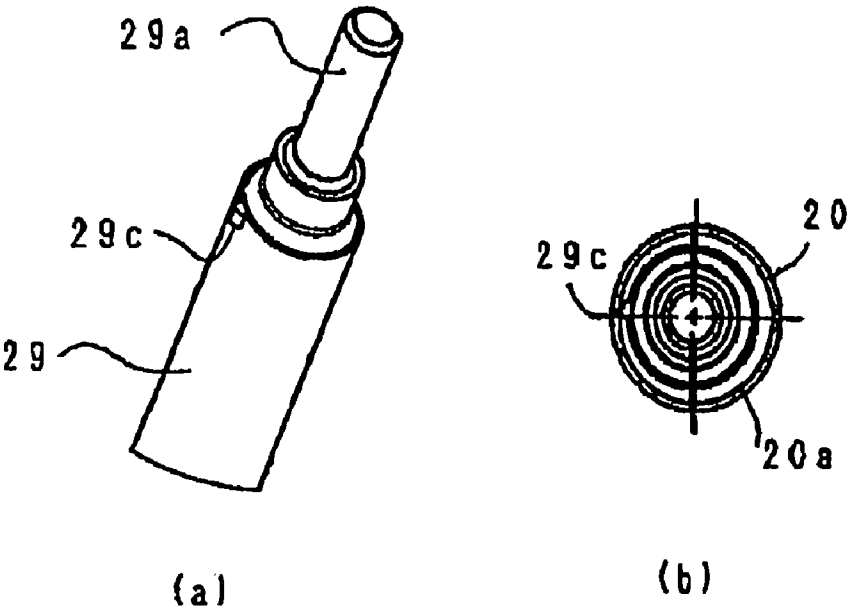
FIGS. 3(*a*) and 3(*b*) illustrate an example of a configuration of an end of a stationary magnet having a small diameter, according to a first embodiment of the present invention.

In the example of FIGS. 3(*a*) and 3(*b*), the magnet 29 is provided at its end with one projected configuration portion. By doing so, when the magnet 29 is inserted into the blank tube 18, projected configuration portion 29*c* is contacted to or abutted to the inside circumference 20*a* of the blank tube 18. By doing so, the eccentricity between the axis of the magnet 29 and the axis 200 of the blank tube 18 can be made small. As a result, the clearance between the supporting shaft 29*a* and the inside circumference 19*a* of the flange 19 is substantially constant all around. Thus, the flange 19 can be easily press-fitted into the opening 18*b* of the blank tube 18.

Figure 4:
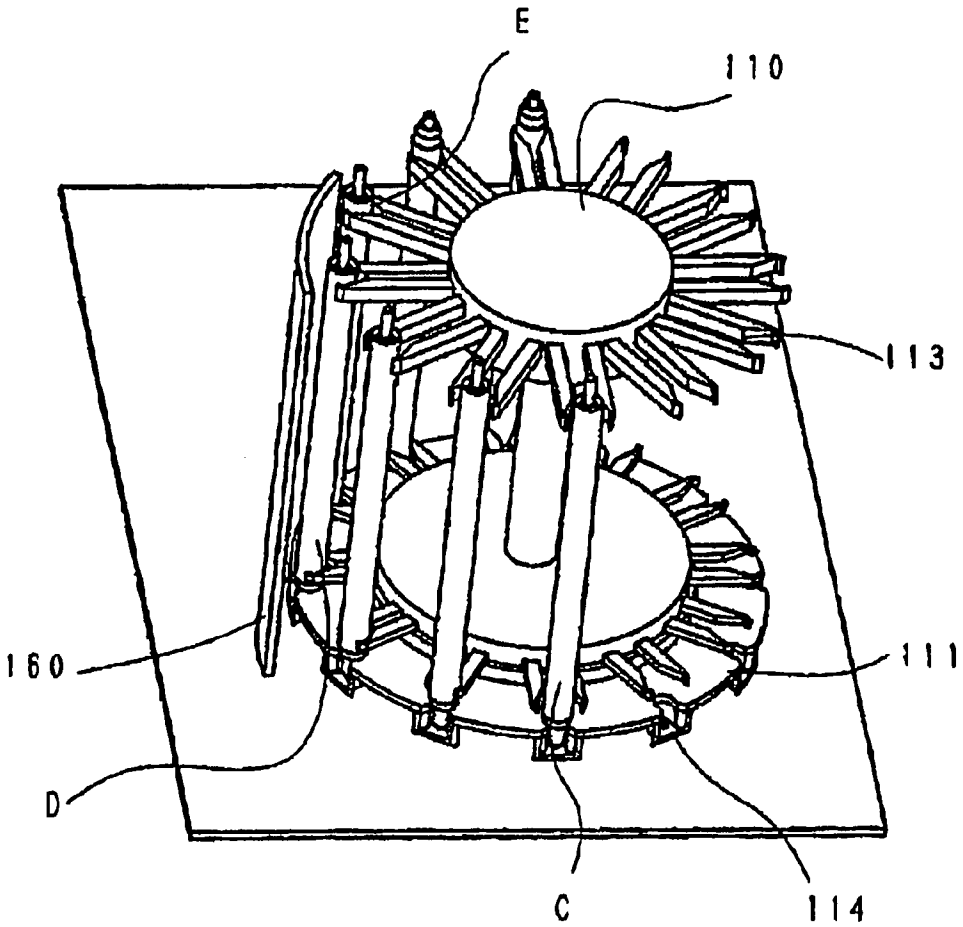
FIG. 4 is a schematic view of a developing roller in a developing roller assembling device, wherein one projected portion of the stationary magnet is abutted.

In the case of the magnet 29 having a 29*c* as shown in FIGS. 2(*a*), 2(*b*), 3(*a*), and 3(*b*), it is desired to assuredly contact the projected configuration portion 29*c* to the inside circumference 28*a* of the blank tube 18. A description will be provided as to a method of assuring the contact or the abutment between the projected configuration portion 29*c* and the inside circumference 20*a*. FIG. 4 schematically shows a developing roller feeding portion which is effective to contact the projected configuration portion 29*c* at one point of the magnet 29. The abutment surface 111 of the feeding turret 110 is provided with a phase aligning portion 114. In addition, a magnetic plate 160 is disposed outside of the position D of the feeding turret 110 and the position E of the flange press-fitting.

Figure 5:
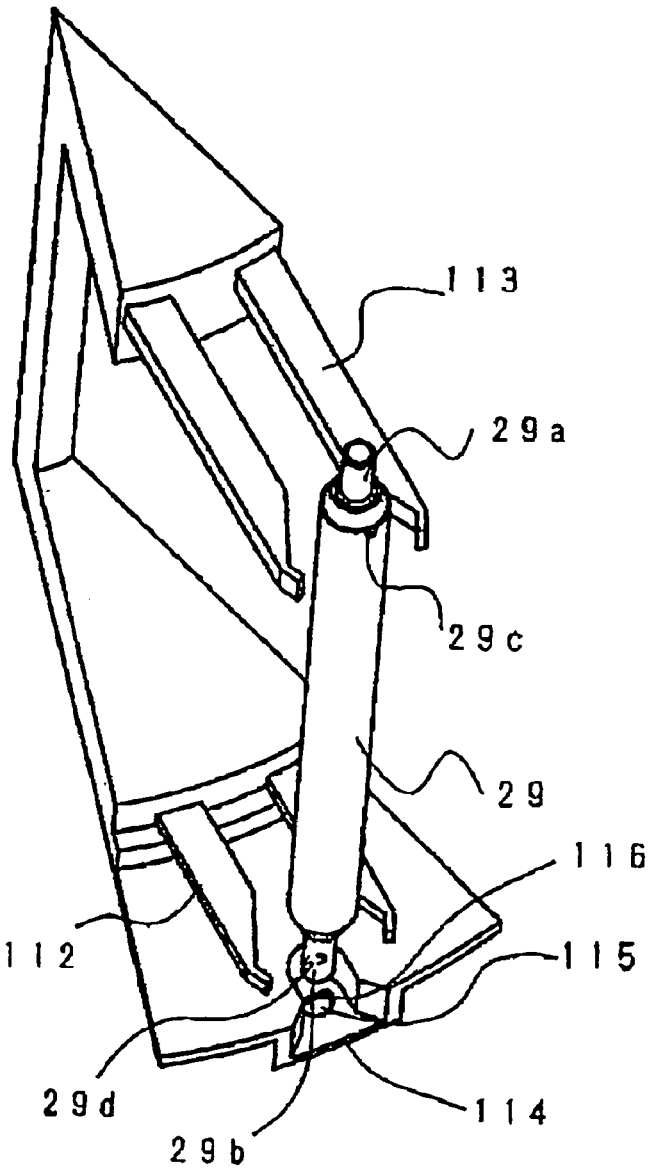
FIG. 5 illustrates a structure for phase alignment of the stationary magnet in a developing roller assembling apparatus implementing an assembling method according to the first embodiment of the present invention.

FIG. 5 illustrates a phase alignment structure of the magnet 29 in the developing roller assembling apparatus. The phase aligning portion 114 of the feeding turret 110 is provided with a phase alignment hole 115 having a diameter slightly larger than that of the supporting shaft 29*b*, and a flat surface 116. The blank tube 18 is set at the position C of the feeding turret 110. At this time, the insertion of the magnet 29 is such that a cut-away portion 29*e* of the supporting shaft 29*b* and the plane 116 of the phase alignment hole 115 face each other. Here, the one point projected configuration portion of the magnet 29 is at the outside position of the feeding turret 110.

In FIG. 4, when the blank tube 18 is fed to the position D, the clamp 113 clamps the upper portion of the blank tube 18. Simultaneously, the magnet 29 is attracted on the magnetic plate 160. And, the one point projected configuration portion 29*c* is contacted or abutted to the inside circumference 20*a* of the blank tube 18. Thereafter, the blank tube 18 is fed to the flange press-fitting position E. Then, the flange 19 is press-fitted into the blank tube 18. In the case of two point projected configuration 29*c*, when the blank tube 18 is mounted to the feeding turret 110, the phase of the two projected configuration portions 29*c* is such that they are at outside positions of the feeding turret 110.

Second Embodiment

A description will be provided as to a second embodiment of the present invention. In this embodiment, the structure of the assembling apparatus for the developing roller is similar to that of the assembling apparatus of the first embodiment, except that the structure of the small diameter stationary magnet is different. In this embodiment, the small diameter stationary magnet (magnet) 30 has a non-circular cross-section, by which the eccentricity of the magnet 30 can be avoided.

Figure 6:
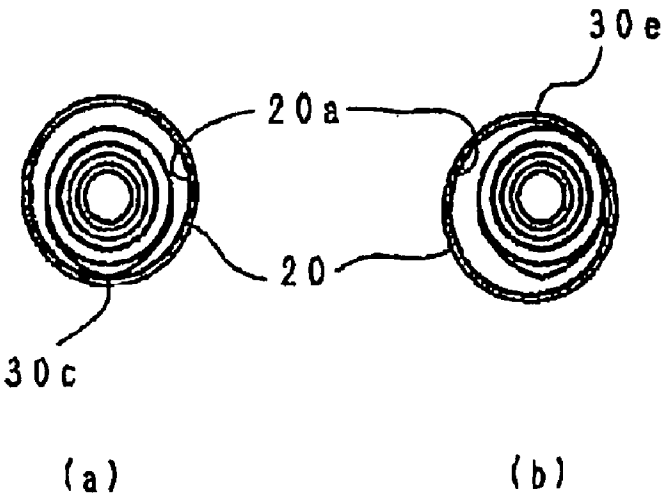
FIGS. 6(*a*) and 6(*b*) illustrate a computation of an end of a stationary magnet having a non-circular cross-section, according to an assembling method of a second embodiment of the present invention.
Figure 7:
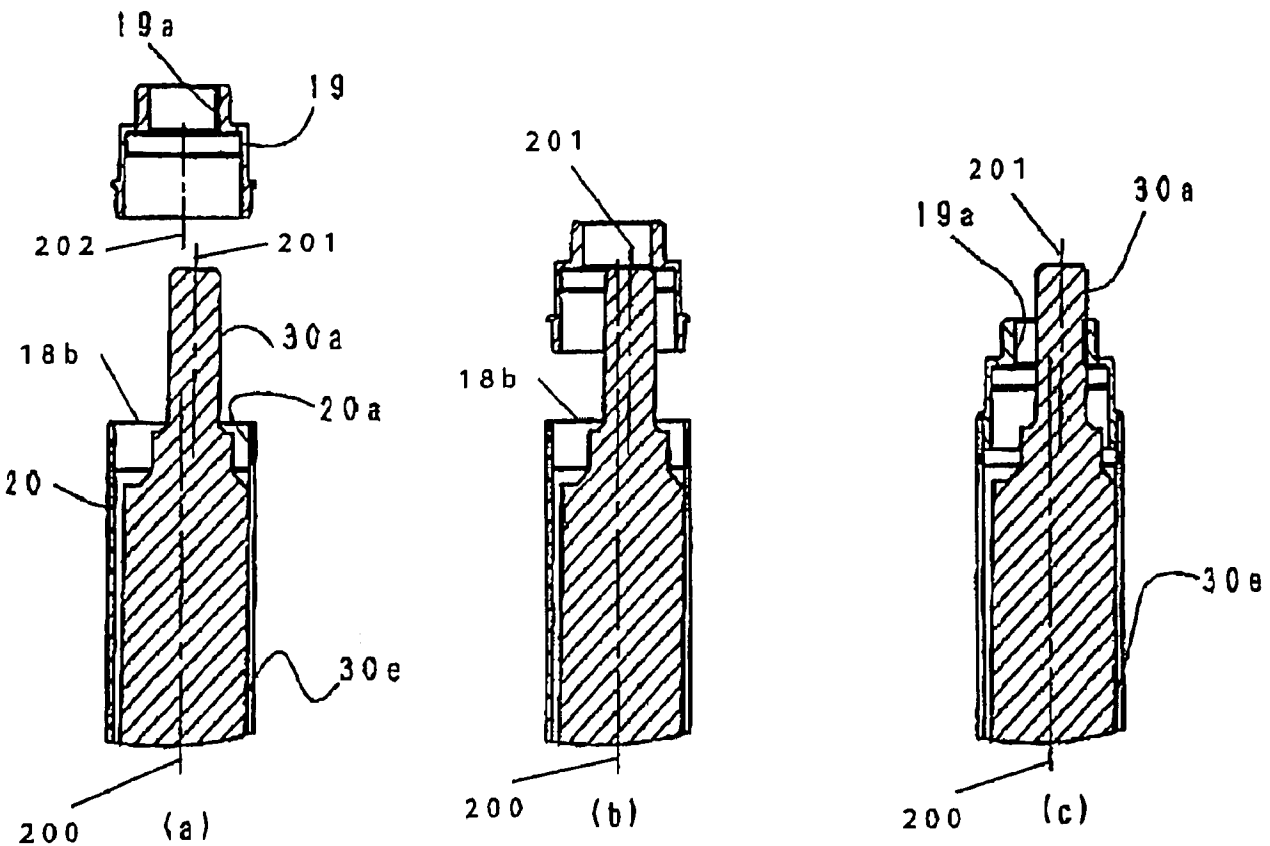
FIGS. 7(*a*) through 7(*c*) illustrate a large eccentricity of the non-circular stationary magnet in conjunction with a state show in FIG. 6(*b*).

This embodiment uses u the fixed magnet 30 having a non-circular column configuration as shown in FIGS. 6(*a*) and 6(*b*). When a large diameter portion 30*e* of the fixed magnet 30 is contacted to or abutted to the inside circumference 20*a* (FIG. 6, (*b*)), the eccentricity between the axis 200 of the blank tube 18 and the axis 201 of the magnet 30 is large. As a result, as shown in FIGS. 7(*a*) through 7(*c*), there arises a liability that the supporting shaft 30*a* of the magnet 30 interferes with the inside circumference 19*a* of the flange 19.

The magnet 30 is inserted into the blank tube 18. As shown in FIG. 6(*a*), the outwardly projected configuration portion (outward projection) 30*c* of the magnet 30 is abutted to the inside circumference 20*a* of the blank tube 18. By doing so, the eccentricity between the axis 200 of the blank tube 18 and the axis 201 can be minimized. As a result, the clearance between the supporting shaft 30*a* of the magnet 30 and the inside circumference 19*a* of the flange 19 is substantially constant all around. Thus, the flange 19 can be easily press-fitted into the opening 18*b* of the blank tube 18.

Figure 8:
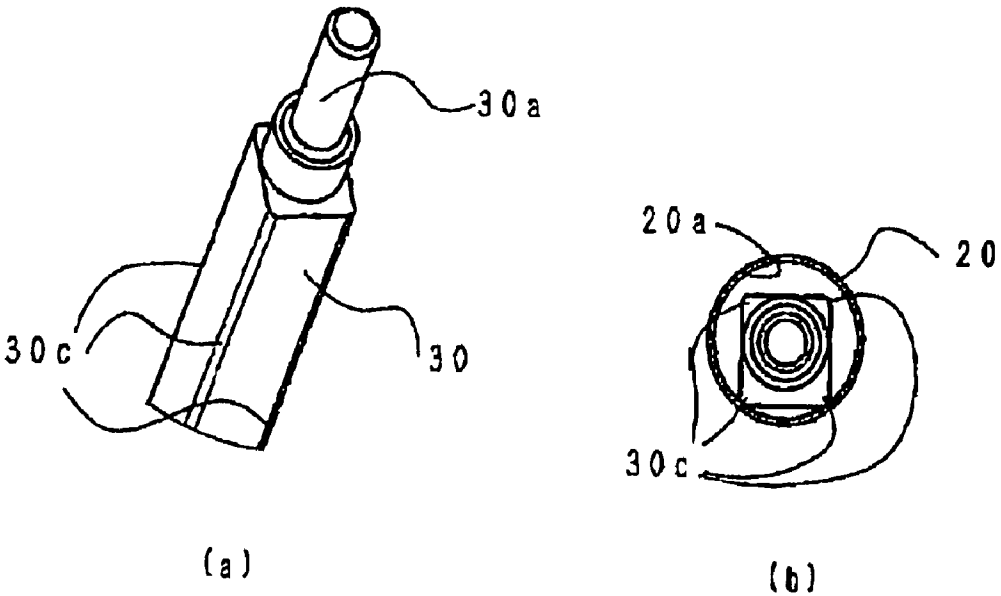
FIGS. 8(*a*) and 8(*b*) illustrate a computation of an end of a stationary magnet having a non-circular cross-section in which a plurality of outward projections are provided.

In this embodiment, the projected configuration portion 30*c* of the magnet 30 is provided at one position. In the case that there are provided a plurality of projected configuration portions 30*c* as shown in FIGS. 8(*a*) and 8(*b*), two projected configuration portions 30*c* are contacted to the inside circumference of the blank tube 18. By doing so, a constant clearance can be provided between the consideration and the inside circumference 19*a* of the flange 19.

Figure 9:
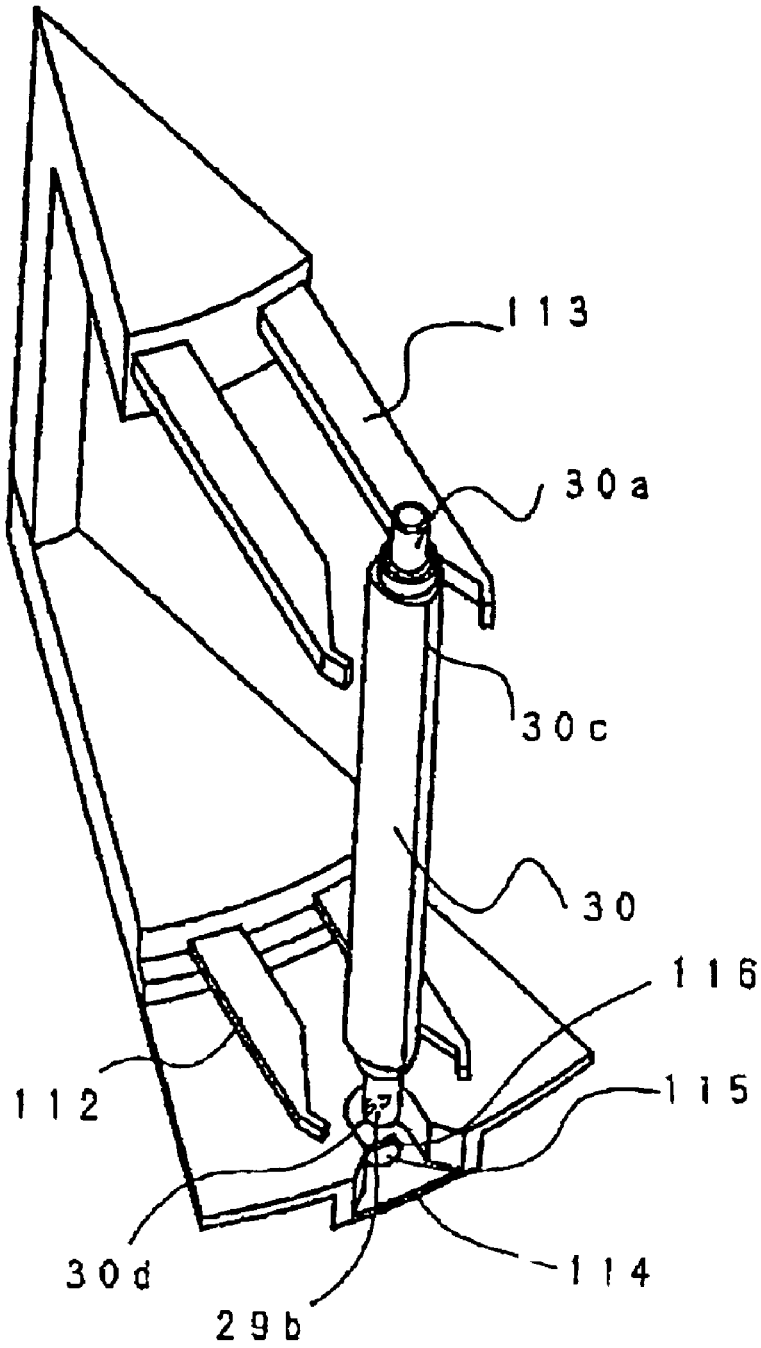
FIG. 9 illustrates a structure for phase alignment of a small diameter stationary magnet in an assembling apparatus implementing the developing roller assembling method according to the second embodiment of the present invention.
Figure 10:
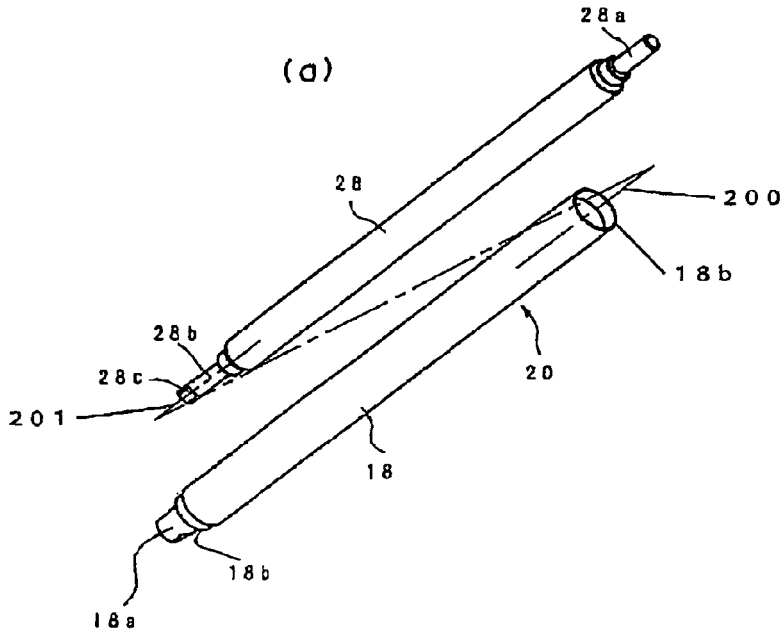
FIG. 10 PRIOR ART
FIGS. 10(*a*) and 10(*b*) schematically illustrate a conventional developing roller.
Figure 10:
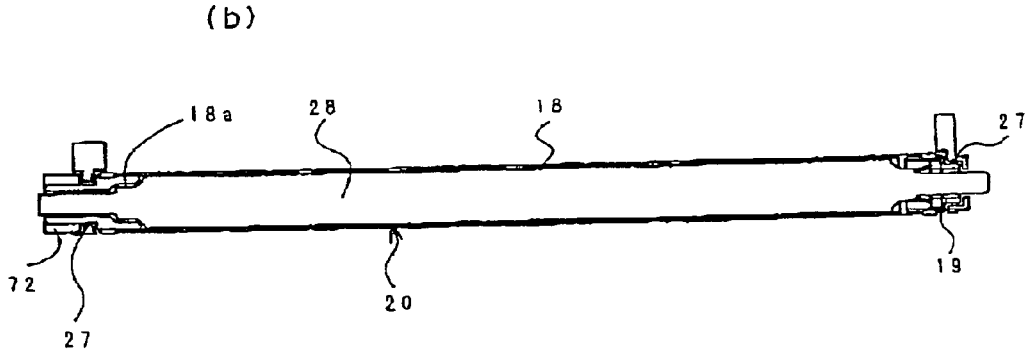
FIG. 10 PRIOR ART
Figure 11:
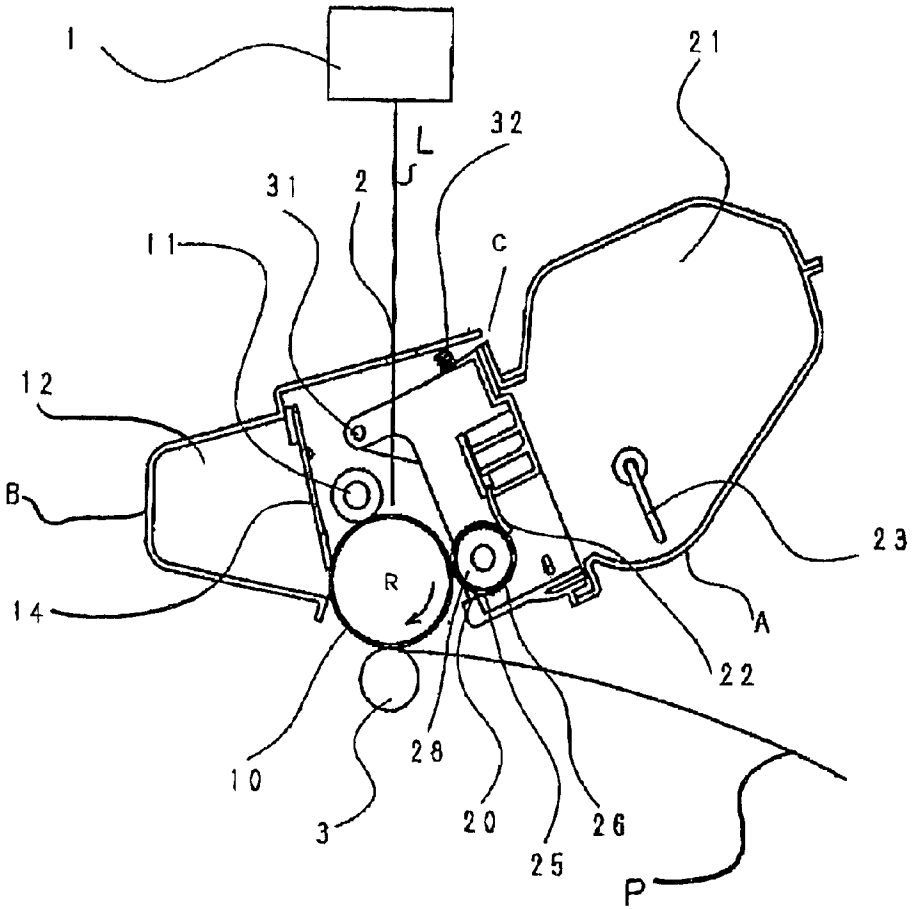
PRIOR ART FIG. 11
FIG. 11 illustrates an exemplary process cartridge using a developing roller.
Figure 12:
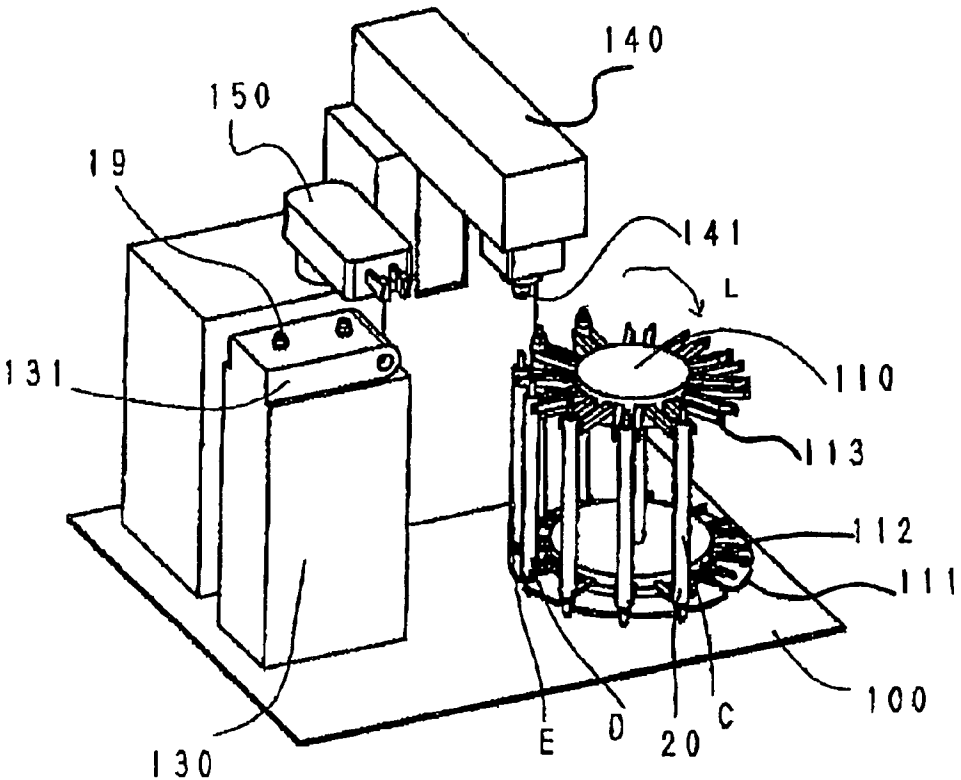
FIG. 12 PRIOR ART
FIG. 12 is a schematic view of a conventional developing roller.
Figure 13:
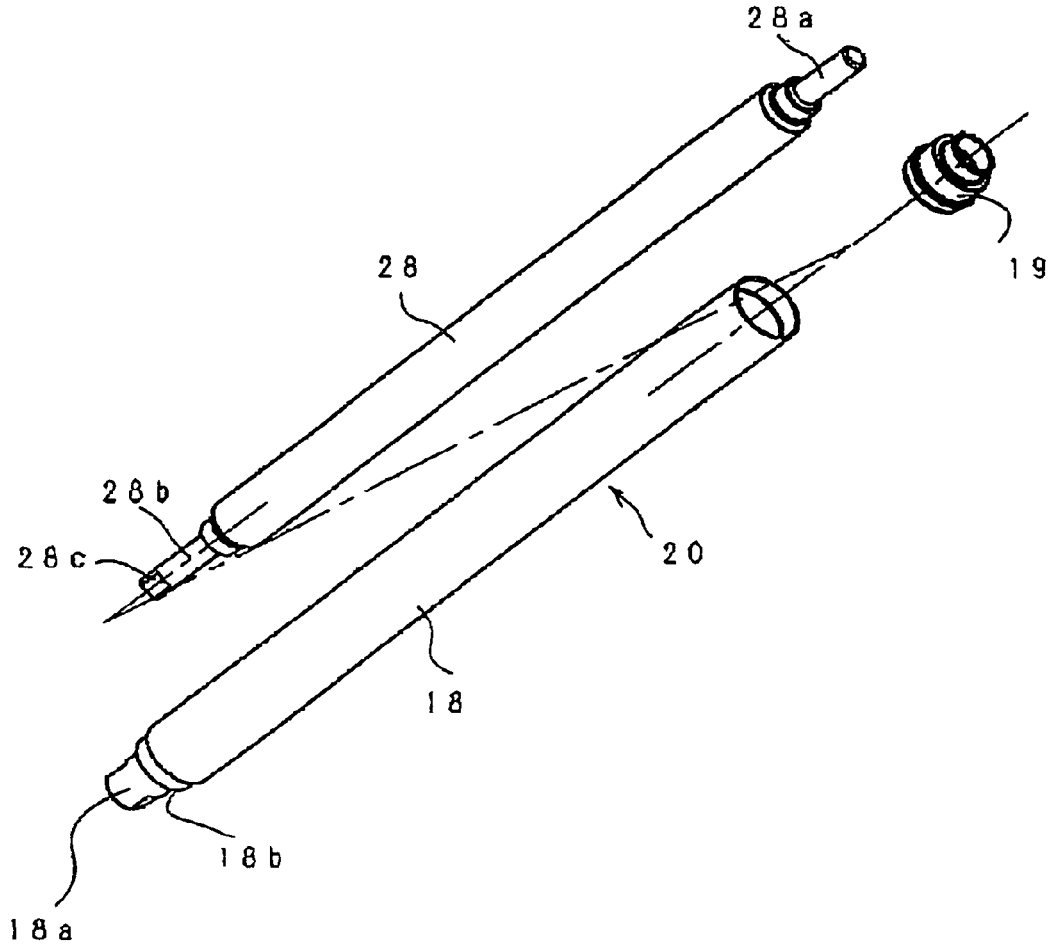
FIG. 13 PRIOR ART
FIG. 13 schematically illustrates a conventional assembling operation for the developing roller.
Figure 14:
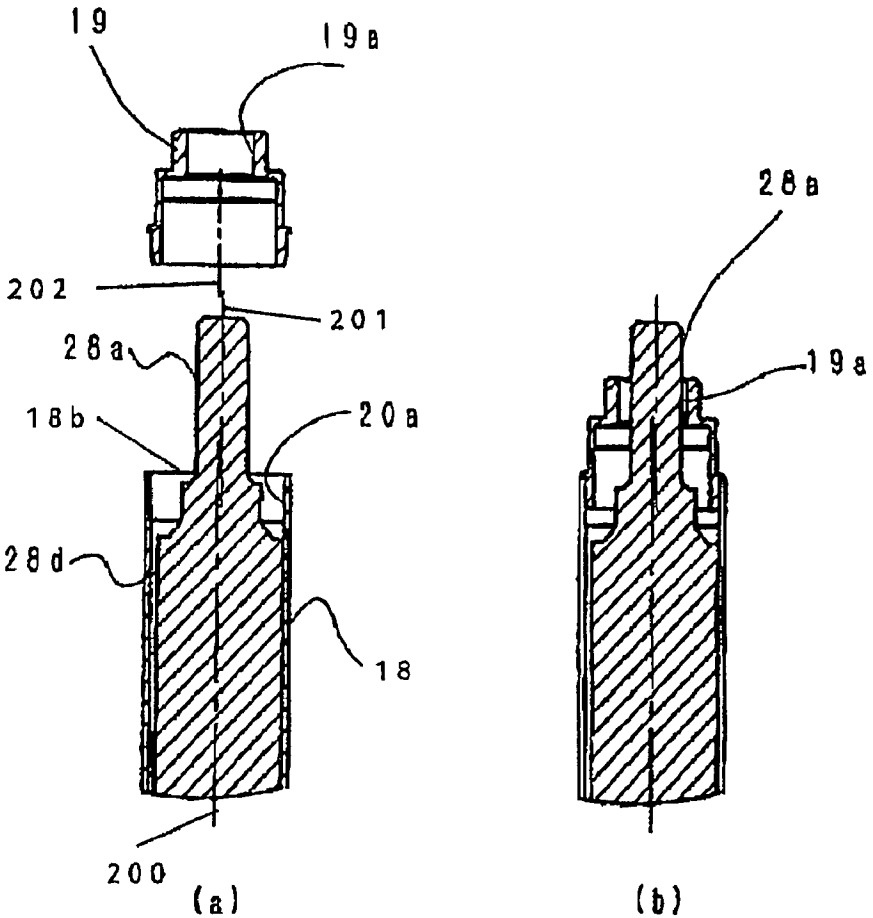
FIG. 14 PRIOR ART
FIGS. 14(*a*) and 14(*b*) illustrate insertion of a magnet having a large diameter into a developer carrying member.
Figure 15:
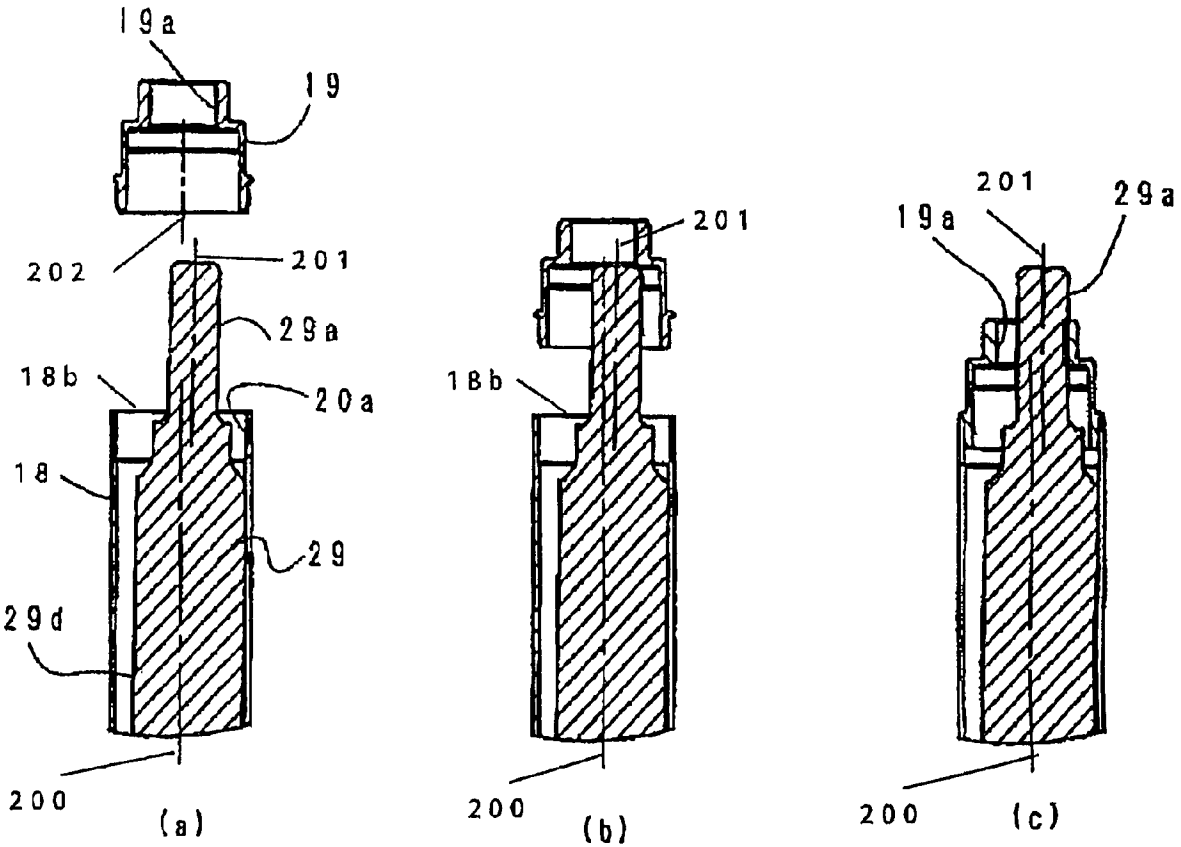
FIG. 15 PRIOR ART
FIGS. 15(*a*) through 15(*c*) illustrate insertion of a magnet having a small diameter into a developer carrying member in conventional method.

A description will be provided as to the means for contacting the projected configuration portion 30*c* to the inside circumference 20*a* of the blank tube 18. In the case of the feeding turret 110 shown in FIG. 4, the blank tube 18 is set at the position C of the feeding turret 110. At this time, as shown in FIG. 9, the magnet 30 is inserted such that a cut-away portion 30*d* and the plane 116 of the phase alignment hole 115 face each other. Then, the projected configuration portion 30*c* is disposed at an outside portion of the feeding turret 110. In FIG. 4, when the blank tube 18 is fed to the position D, the clamp 113 clamps the upper portion of the blank tube 18. Simultaneously, the magnet 30 is attracted to the magnetic plate 160, the projected configuration portion 30*c* is contacted to the inside circumference 20*a* of the blank tube 18. Thereafter, the blank tube 18 is fed to the flange press-fitting position E, and the flange 19 can be easily press-fitted into the opening 18*b* of the blank tube 18.

Embodiment 1

The assembling method according to the first embodiment is summarized as follows:

An assembling method for a developing roller (20) usable with an electrophotographic developing device (A), the developing roller including a developer carrying member (18) in the form of a hollow cylinder, a flange member (19) provided at an end of the developer carrying member, and a magnet (29) provided in the developer carrying member, the method comprising:

an inserting step of inserting the magnet (29) having a small diameter and having at least one projection (29*c*) into an inside of the developer carrying member (18) through an opening (18*b*) of the developer carrying member (18);

an abutting step of abutting the at least one projection (29*c*) to an inside surface of the cylindrical developer carrying member (18); and an engaging step of engaging the flange member with the opening (18*b*) by penetrating the flange member with a shaft (29*a*) and of the magnet projected out of the opening.

Embodiment 2

The assembling method according to the second embodiment is summarized as follows:

An assembling method for a developing roller usable with an electrophotographic developing device (A), the developing roller including a developer carrying member (18), a flange member (19) provided at an end of the developer carrying member (18), and a magnet (30) provided in the developer carrying member (18), the method comprising:

an inserting step of inserting the magnet (30), which has a columnar configuration having a non-circular cross-section and which has at least one outer projection (30*c*), into the inside of the developer carrying member (18), which has a hollow cylindrical shape;

an abutting step of abutting the at least one outer projection (30*c*) to an inside surface of the cylindrical developer carrying member (18); and an engaging step of engaging the flange member (19) with an opening (18*b*) of the developer carrying member by penetrating the flange member (19) with a shaft of the magnet (30) projected out of the opening.

Embodiment 3

In the abutting step, the magnets 29, 30 are abutted to the inside surface 20*a* of the cylindrical developer carrying member 18 in this embodiment.

Embodiment 4

In the abutting step, when the magnets 29, 30 are abutted to the inside surface 20*a* of the developer carrying member 18, a cut-away portion 28*c* provided at an end 28*b* of the magnets 29, 30 can be used as positioning means.

As described in the foregoing, according to the embodiments of the present invention, the magnet can be inserted into the developer carrying member with suppressed eccentricity by abutting a projection provided on the magnet to the inside surface of the cylindrical developer carrying member. In addition, according to the embodiment of the present invention, the developer carrying member and magnet can be easily assembled.

As described in the foregoing according to the present invention, a developing roller can be easily assembled.

While the invention has been described with reference to the structures disclosed herein, it is not confined to the details set forth, and this application is intended to cover such modification or changes as may come within the purposes of the improvements.

What is claimed is:

1. An assembling method for a developing roller usable with a developing device, the developing roller including a developer carrying member in the form of a hollow cylinder, a flange member provided at an end of the developer carrying member, and a magnet provided in the developer carrying member, said method comprising:

an inserting step of inserting the magnet having at least one projection into the inside of the developer carrying member through an opening therein;

an abutting step of abutting the at least one projection to an inside surface of the hollow cylinder of the developer carrying member to reduce an eccentricity between the axis of the magnet and the axis of the hollow cylinder of the developer carrying member; and an engaging step of engaging the flange member with the opening by penetrating the flange member with a shaft of the magnet projected out of the opening after said abutting step.

2. An assembling method for a developing roller usable with a developing device, the developing roller including a developer carrying member, a flange member provided at an end of the developer carrying member, and a magnet provided in the developer carrying member, said method comprising:

an inserting step of inserting the magnet, which has a columnar configuration having a non-circular cross-section and which has at least one outer projection, into the inside of the developer carrying member, which has a hollow cylindrical shape;

an abutting step of abutting the at least one outer projection to an inside surface of the cylindrical developer carrying member to reduce an eccentricity between the axis of the magnet and the axis of the hollow cylinder of the developer camming member; and an engaging step of engaging the flange member with an opening of the developer carrying member by penetrating the flange member with a shaft of the magnet projected out of the opening after said abutting step.

3. A method according to claim 1 or 2, wherein in said abutting step, the magnet is abutted to the inside surface of the cylindrical developer carrying member by attracting the magnet with a magnetic force.

4. A method according to claim 3, wherein in said abutting step, the magnet is correctly positioned using a cut-away portion provided at an end of the magnet.

5. A method according to claim 1 or 2, wherein the projection is provided to extend along a full circumference of the magnet or at one or two positions.

* * * * *

UNITED STATES PATENT AND TRADEMARK OFFICE

CERTIFICATE OF CORRECTION

PATENT NO. : 7,156,797 B2
APPLICATION NO. : 10/702614
DATED : January 2, 2007
INVENTOR(S) : Noriyuki Komatsu et al.

It is certified that error appears in the above-identified patent and that said Letters Patent is hereby corrected as shown below:

COLUMN 3:
Line 33, “easy” should read --easily--.

COLUMN 4:
Line 39, “in” should read --in a--.

Signed and Sealed this

Twenty-ninth Day of July, 2008

JON W. DUDAS
*Director of the United States Patent and Trademark Office*